US006536190B1

(12) United States Patent
Webb et al.

(10) Patent No.: US 6,536,190 B1
(45) Date of Patent: Mar. 25, 2003

(54) MULTI-WALL SACK

(75) Inventors: Anthony Webb, MacLeod (AU); Larry Challis, Eden Park (AU)

(73) Assignee: Amcor Packaging (Australia) Pty Ltd., Camberwell (AU)

( * ) Notice: Subject to any disclaimer, the term of this patent is extended or adjusted under 35 U.S.C. 154(b) by 27 days.

(21) Appl. No.: 09/297,065

(22) PCT Filed: Oct. 31, 1997

(86) PCT No.: PCT/AU97/00731

§ 371 (c)(1),
(2), (4) Date: Oct. 5, 1999

(87) PCT Pub. No.: WO98/18691

PCT Pub. Date: May 7, 1998

(30) Foreign Application Priority Data

Oct. 31, 1996 (AU) ..... PO3355

(51) Int. Cl.[7] ..... B65B 11/58
(52) U.S. Cl. ..... 53/449; 53/481; 53/482
(58) Field of Search ..... 53/449, 482, 481, 53/133.8, 372.5, 415; 383/109

(56) References Cited

U.S. PATENT DOCUMENTS 3,577,699 A * 5/1971 Silver ..... 53/449
4,236,368 A * 12/1980 Nerenberg et al. ..... 53/449
4,353,770 A * 10/1982 Kuckhermann
4,450,581 A * 5/1984 Hirata ..... 383/109
5,007,233 A * 4/1991 Bose ..... 53/449
5,152,735 A * 10/1992 Podd, Jr. et al.
5,365,720 A * 11/1994 Bunch ..... 53/449
5,417,039 A * 5/1995 Hansson et al. ..... 53/449
5,644,900 A * 7/1997 Steele et al. ..... 53/449
5,727,364 A * 3/1998 Artieda ..... 53/415

FOREIGN PATENT DOCUMENTS

FR 2108379 5/1972
WO 92/22474 12/1992

* cited by examiner

*Primary Examiner*—Eugene Kim
(74) *Attorney, Agent, or Firm*—Dennison, Schultz & Dougherty

(57) ABSTRACT

A multi-wall sack (3) containing a product is disclosed together with a method of forming and sealing such a sack. The sack (3) includes an inner pouch that is filled with product and sealed. The sack (3) also includes an outer bag that encloses the sealed inner pouch and which has a block bottom end (5*a*) and a block top end (5*b*).

4 Claims, 2 Drawing Sheets

MULTI-WALL SACK

The present invention relates to a multi-wall sack.

The present invention relates particularly to a multi-wall sack which comprises an outer bag, typically formed from paper, and an inner pouch, typically formed from a polymeric material.

The present invention relates more particularly although by no means exclusively, to a multi-wall sack of the type described in the preceding paragraph which is suitable for storing dry food products, such as powdered milk products.

A known multi-wall paper/polymeric material sack for dry food products comprises an inner polyethylene pouch and an outer paper bag having a block (ie rectangular bottom end.

The block bottom end provides a flat closed base for the sack and is formed by folding the outer paper bag (and not the inner polyethylene bag) in a specific manner during manufacture of the sack. The arrangement is such that when the sack is filled through the opposite open end, the dry food products in the inner polyethylene pouch push against the folded closed end and cause it to flatten out to create the block bottom end.

After the sack has been filled, the open end of the polyethylene pouch is closed by pressing together the polyethylene material along a line spaced a short distance from the end of the sack and heat sealing together the polyethylene material along the line.

Thereafter, the open end sections of the paper outer bag that are on opposite sides of the heat seal line are pressed together and then folded back and adhered together to form a pinched top end of the sack.

In terms of overall shape, the above-described known sack is wedged-shaped, with the front and rear sides converging from the block bottom end to the pinched top end.

Whilst the known sack has acceptable properties from the viewpoint of long-term storing dry food products, a disadvantage of the sack is that the wedge-shape is not ideal for stacking on pallets. This is a disadvantage because it affects the transportation of filled sacks to an end location. In many situations, particularly export oriented industries, this can be a serious disadvantage.

An object of the present invention is to provide a multi-wall sack which is not subject to the disadvantage described in the preceding paragraph to the same extent as the known multi-wall sack.

According to the present invention there is provided a multi-wall sack containing a product, which sack comprises:

(a) an inner pouch that is filled with product and sealed;

(b) an outer bag that encloses the sealed inner pouch and comprises a block bottom end and a block top end.

According to the present invention there is also provided a multi-wall sack which comprises:

(a) an inner pouch that is adapted to be filled with product and sealed; and (b) an outer bag that is manufactured with a block bottom end and is adapted to be closed, after the inner pouch has been filled with product and closed, to form a block top end.

The above-described filled sack has a substantially uniform depth along the length of the sack and therefore can be stacked effectively and efficiently on a pallet.

The inner pouch and the outer bag may be formed from any suitable material.

It is preferred that the inner pouch be formed from a polymeric material.

It is preferred that the outer bag be formed from paper.

It is preferred particularly that the outer bag comprise a plurality of layers of paper.

It is preferred that the outer bag contains an easy open device that facilitates removal of the inner bag.

According to the present invention there is also provided a method of forming a closed multi-wall sack having an inner bag and an outer bag which encloses the inner bag and has block ends, the method comprising the following steps at the completion of filling a product into the sack through an open end of the sack:

(i) sealing the product in the inner bag;

(ii) opening out the sides of the outer bag at the open end of the sack to form outturned side flaps and inturned triangular wings;

(iii) folding inwardly an outer section of one of the flaps onto the inner section of the flap;

(iv) folding inwardly an outer section of the other flap onto the inner section of the flap and to overlap partially the folded flap so that the outer bag forms a block end; and (v) adhering or otherwise holding together the block end.

It is preferred that step (i) comprises sealing the product in the inner bag by pressing together the inner bag along a line extending across a section of the inner bag in the region of the open end of the sack and heat sealing the inner bag along the line.

It is preferred particularly that, after step (i) and before the step (ii), the method comprises trimming the length of the sack above the seal line.

It is preferred that step (v) comprises adhering a cover label over the folded block end.

The label may or may not contain an easy-open device.

The present invention is described further by way of example with reference to the accompanying drawings, of which:

The preferred embodiment of a multi-walled sack in accordance with the present invention is formed from an inner pouch of polymeric material and an outer multi-layer bag formed from paper. It is noted that the sack may be formed from any other suitable materials.

Figure 6:
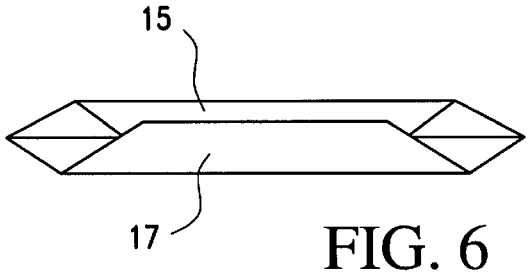
Figure 7:
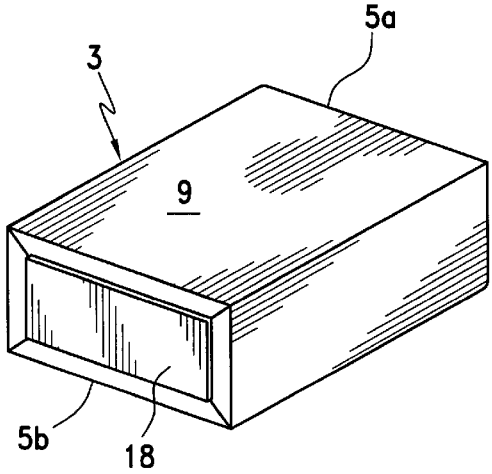
FIG. 7 is a perspective view of the top end of the sack shown in FIG. 1 after the open of the sack has been closed.

As illustrated in FIG. 7, when filled with product and closed, the sack 3 has a substantially uniform depth along the length of the sack and the outer bag has block ends 5*a*, 5*b*. The closed sack is therefore suitable to be stacked efficiently and effectively on a pallet As is discussed in more detail in relation to FIGS. 3 to 6, in accordance with the preferred embodiment of the present invention the closed sack 3 is formed by a sequence of steps which includes:

(i) filling with product an as-manufactured form of the sack 3 which has an open top end to allow product into the inner pouch and an outer bag with a block bottom end 5*a;*

(ii) sealing the inner pouch of the sack;

(iii) trimming the closed end of the sack; and (iv) folding the outer bag at the open top end to form a block top end.

Figure 1:
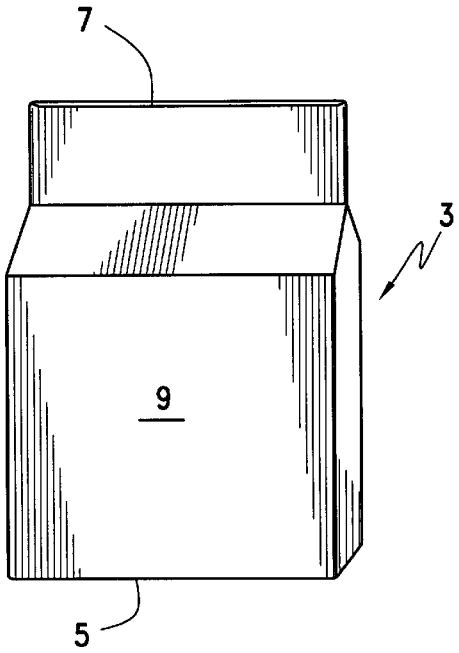
FIG. 1 is side elevation of a multi-layer sack in accordance with a preferred embodiment of the present invention.
Figure 2:
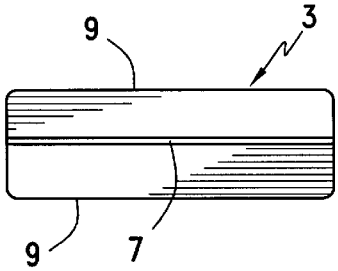
FIG. 2 is a top plan view of the open end of the sack shown in FIG. 1 after the sack has been filled with product and before the sack is sealed.

FIGS. 1 and 2 are, respectively, a side view and a top plan view of the sack 3 after it has been filled with product and before it has been sealed. With reference to FIGS. 1 and 2, the reference numeral 7 indicates the edge of the outer bag at the open end of the sack 3 and the reference numerals 9 indicate the bulging opposed side walls of the filled sack 3.

The sack may be filled with product by any suitable means.

FIGS. 3 to 6 illustrate a preferred sequence of steps to seal the open top end of the sack 3 shown in FIGS. 1 and 2.

Figure 3:
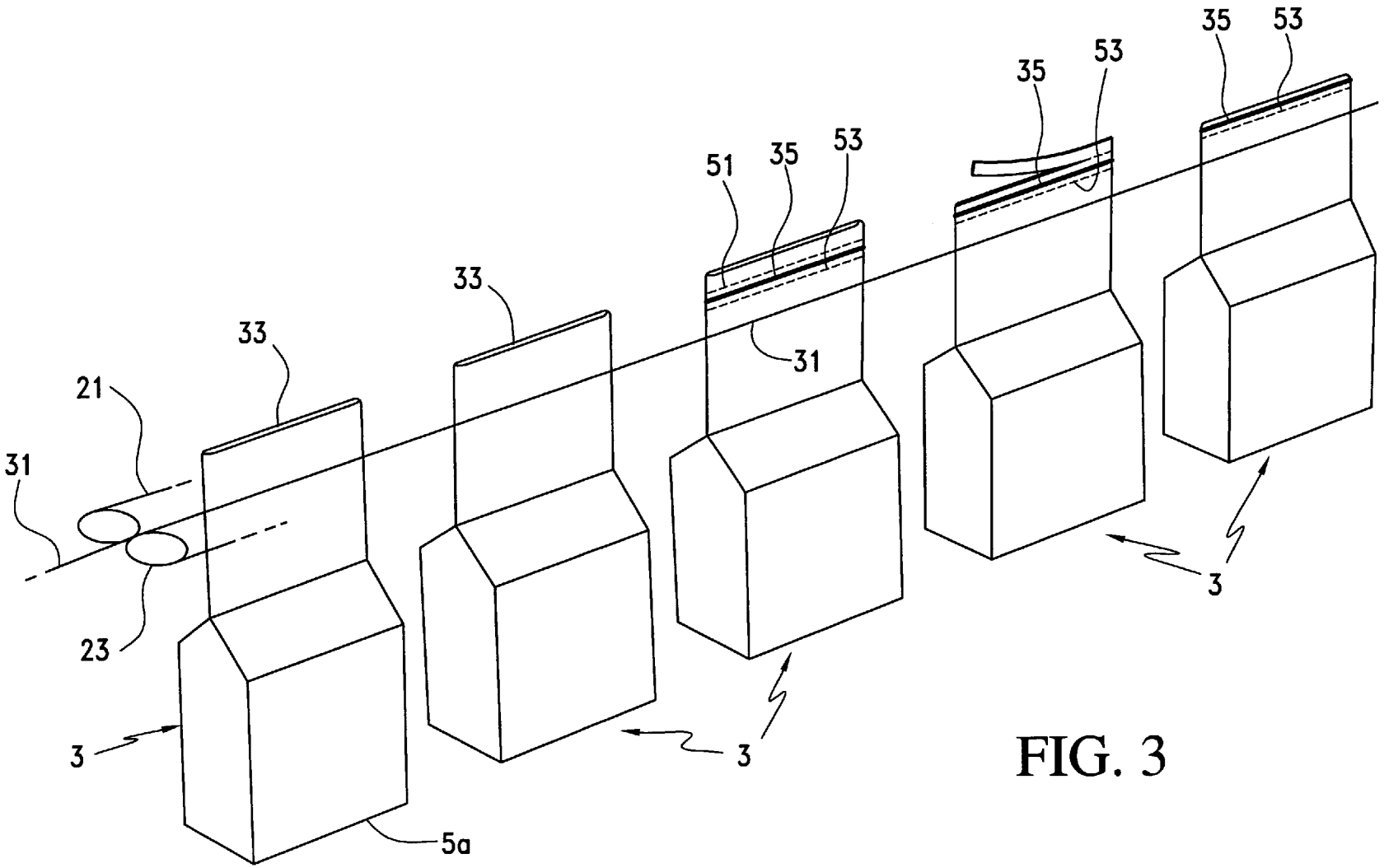
FIG. 3 is a schematic diagram which illustrates a preferred embodiment of a sequence of steps to seal the sack shown in FIGS. 1 and 2.

With reference to FIG. 3, the filled sack 3 is transferred from a filling station to an entry end 21 of a conveyor assembly 23 that thereafter supports and transports the sack 3 while the sequence of steps to seal the sack 3 are carried out.

The conveyor assembly 23 comprises a pair of parallel continuous belts that are positioned to clamp together opposed sides of the open top end of the sack 3. The reference numeral 31 indicates the clamp line.

With reference to FIG. 3, the first step in the sequence comprises adjusting to a pre-determined length the spacing between the upper edge 33 of the sack 3 and the clamp line 31 of the conveyor assembly 23.

The next step in the sequence comprises pressing together the inner pouch along a line extending across a section of the inner pouch and thereafter heat sealing the inner pouch along the line. The reference numeral 35 indicates the heat seal. The position of the heat seal line 35 is selected to be:

(i) between the upper edge 33 of the sack 3 and the clamp line 31;

(ii) between upper and lower continuous or discontinuous glue lines 51, 53 that adhere together the inner pouch and the outer bag on one side of the sack 3; and (iii) below one upper continuous or discontinuous glue line 51 that adheres together the inner pouch and the outer bag on the outer side of the sack 3.

The next step in the sequence comprises trimming off the top end of the sack 3 to remove the upper glue lines 51—while leaving the lower glue line 53—and to reduce the length of the outer bag above the seal line 31 to a preferred length for forming a block end.

Figure 4:
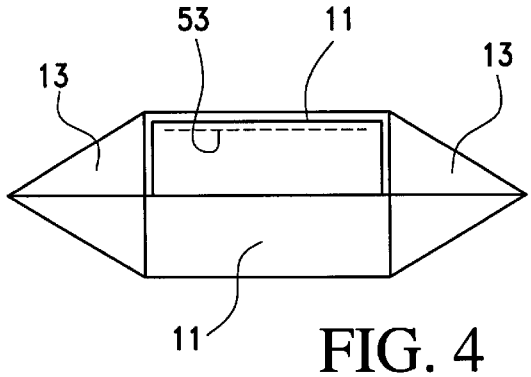
FIGS. 4 to 6 are top plan views of the open end of the sack shown in FIGS. 1 and 2 which illustrate the sequence of folds made to close the open end into a block end configuration in accordance with a preferred embodiment of the present invention.

With reference to FIG. 4, the next step in the sequence comprises opening out the upper sides of the outer bag in the region of the open end of the sack 3 to form outwardly turned side flaps 11 and, as a consequence of the outward folding of the upper sides, inwardly turned triangular wings 13.

It is noted that, in view of the glue line 53, the inner pouch folds with the side of the outer bag to which it is adhered. It is also noted that this glue line does not permanently retain the inner pouch to the outer bag and that once the outer bag has been closed with a block end, the inner pouch can (and does) separate from the outer bag.

Figure 5:
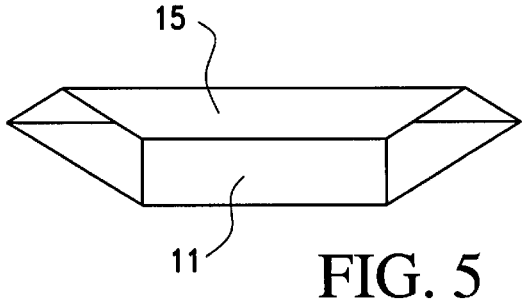

With reference to FIG. 5, the next step in the sequence comprises folding inwardly an outer section of one of the flaps 11 onto itself to form an inturned fold 15.

With reference to FIG. 6, the next step in the sequence comprises folding inwardly an outer section of the other flap 11 onto itself and to partially overlap the fold 15 to form an inturned fold 17. This step completes the formation of a block end of the sack.

The final step in the sequence comprises adhering a cover label 18 to the folded block end 5*b* shown in FIG. 7.

The above described method steps can be carried out automatically.

Many modifications may be made to the preferred embodiments described above with reference to the drawings without departing from the spirit and scope of the invention.

In the claims which follow and in the preceding description of the invention, the words "comprising" and "comprises" are used in the sense of the word "including", ie the features referred to in connection with these words may be associated with other features that are not expressly described.

What is claimed is:

1. A method of forming a closed multi-wall sack having an inner bag and an outer bag which encloses the inner bag and has block ends, the method comprising the following steps at the completion of filling a product into the sack through an open end of the sack:

(i) sealing the product in the inner bag;

(ii) opening out the sides of the outer bag at the open end of the sack to form outturned side flaps and inturned triangular wings;

(iii) folding inwardly an outer section of one of the flaps onto the inner section of the flap;

(iv) folding inwardly an outer section of the other flap onto the inner section of the flap and to overlap partially the folded flap so that the outer bag forms a block end; and (v) adhering or otherwise holding together the block end.

2. The method defined in claim 1 wherein step (i) comprises sealing the product in the inner bag by pressing together the inner bag along a line extending across a section of the inner bag in the region of the open end of the sack and heat sealing the inner bag along the line.

3. The method defined in claim 2 further comprises, after step (i) and before step (ii), a step of trimming the length of the sack above the seal line.

4. The method defined in claim 1 or claim 2 wherein step (v) comprises adhering a cover label over the folded block end.

* * * * *